United States Patent [19]

Kress

[11] Patent Number: 4,650,120

[45] Date of Patent: Mar. 17, 1987

[54] SHOWER HEAD

[75] Inventor: Hermann K. Kress, Filderstadt, Fed. Rep. of Germany

[73] Assignee: Hansa Metallwerke AG, Stuttgart, Fed. Rep. of Germany

[21] Appl. No.: 656,224

[22] Filed: Oct. 1, 1984

[30] Foreign Application Priority Data

Oct. 1, 1983 [DE] Fed. Rep. of Germany ..... 3335755

[51] Int. Cl.[4] ..... B05B 11/02

[52] U.S. Cl. ..... 239/446; 137/625.48

[58] Field of Search ..... 239/436, 437, 443–449, 239/586, 587, 383; 137/625.48, 625.25; 251/121

[56] References Cited

U.S. PATENT DOCUMENTS

| | | | |
|---|---|---|---|
| 2,726,120 | 12/1955 | Bletcher et al. | 239/449 |
| 2,792,019 | 5/1957 | Lieser | 137/625.48 |
| 2,952,275 | 9/1960 | Mock | 137/625.48 |
| 3,682,392 | 8/1972 | Kint | 239/447 |
| 3,707,168 | 12/1972 | Boelkins | 137/625.48 |
| 4,330,089 | 5/1982 | Finkbeiner | 239/383 |
| 4,334,552 | 6/1982 | Blanchard | 137/625.48 |
| 4,360,160 | 11/1982 | Jette | 239/587 |

*Primary Examiner*—Joseph F. Peters, Jr.
*Assistant Examiner*—Scott Malpede
*Attorney, Agent, or Firm*—Fred Philpitt

[57] ABSTRACT

In a shower head (12) provided with hard-jet ports (84) and soft-jet ports (88), a partition wall between the distributor chambers (32, 82) communicating with these sets of ports is designed as an insert part (26) which can be inserted from the open end of the housing (14). The partition wall insert part has an integrally formed valve supporting section (38) with connection channels (42, 72, 74) to the feed port (44) and the two distributor chambers (32, 34) respectively and carries a linear slide change-over valve, whose valve seat (50) and valve slide (52) are made of a ceramic material.

15 Claims, 8 Drawing Figures

SHOWER HEAD

The invention relates to a shower head as described in the introductory part of claim 1. Such a shower head is described in DE GM 78 29 867. Therein, the partition wall between the two distributor chambers has been integrally formed with the housing and the base of the housing is designed as a large diameter screw plug and carries an adjusting shaft of the change-over valve as well as the movable control disc of the latter.

In this construction, the housing of the shower head has to be rotationally symmetrical in shape in the environment of the plug so as to ensure that, when the plug has been screwed in, one reliably obtains a continuous outer surface of the housing. One is thus not free in designing the configuration of the shower head.

It is the object of the present invention to provide a shower head as described in the introductory part of claim 1 which requires no separate plug for sealing the valve installation hole.

According to the invention, this problem is solved by a shower head as described in claim 1.

All parts of the shower head according to the invention which are required for the soft-jet unit or the hard-jet unit are introduced from the same side into the cup-shaped housing. One is thus free in designing the outer contour of the housing. The linearly moved actuating members of the change-over valve can be passed through the housing wall without any problem since no water flows through the space between the change-over valve and the housing. This also has the advantage that no water flows around the outer sides of the control discs either, so that it is impossible for any deposits to form there.

Advantageous further developments of the invention are given in the sub-claims.

The further developments of the invention according to claims 2 and 3 make it possible to produce the insert part as well as the housing as plastics material injection mouldings and to ensure, without any increased requirements concerning the accuracy of fit of these parts, sealing between the water supply and the valve outer side and the water supply and the distributor chambers.

The further development of the invention according to claim 4 is of advantage with respect to an easy assembly of the shower head since the change-over valve can be completely pre-assembled on the insert part and is simply moved, together with the latter, into the housing of the shower head.

The further development of the invention according to claims 5 and 6 is of advantage with respect to the easy fitting of actuating members projecting from the shower housing. Following the complete assembly of the change-over valve and the insert part, the actuating members are simply frictionally slipped over the cage and interlocked with the latter.

The further development of the invention according to claim 9 renders possible an easy removal of the partition wall insert part and the change-over valve since the dovetail joint between the actuating members and the control disc cage can be simply pulled apart in the direction of insertion of the partition wall insert part.

With the further development of the invention according to claim 9 there is obtained in a simple manner an interlocking of the movable control disc in its central position.

A shower head according to claim 10 allows the two working positions of the change-over to be easily brought about without a visual check, no high forces being exerted on the sensitive control discs even if the actuating members are moved forcefully into the working position.

The further development of the invention according to claims 12 and 13 ensures in a simple manner flat access to the hard-jet ports in the cover.

According to claim 13, the spacer also has the function of providing a seal between the two distributor chambers.

The further development of the invention according to claim 14 is of advantage with respect to an easy assembly and low production costs of the shower head.

The further development of the invention according to claim 15 ensures that the guide for the movable control disc can be designed so as to be relatively rigid. This allows it to be fastened unilaterally on the insert part.

The invention will hereinafter be explained in more detail with the aid of an exemplified embodiment and with reference to the drawings, in which.

Figure 1:
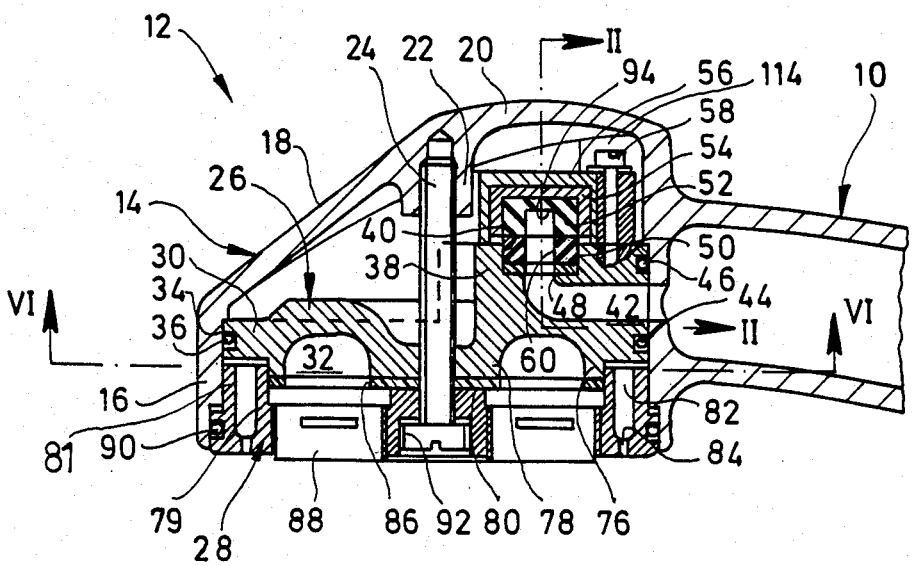
FIG. 1 shows an axial section through a shower head.

FIG. 1 shows the end of a hand shower, whose hollow handle 10, which also serves for delivering the water, carries a shower head designated 12 as a whole. The shower head has a cup-like housing 14, which has been integrally formed with the handle and is provided with a cylindrical peripheral wall 16 and a cup bottom which has a conical wall section 18 as well as a slightly convexly curved wall section 20 which is however substantially transversal to the housing axis.

At the transition point between these two wall sections there is integrally formed with the cup bottom a threaded connector 22, in which a fastening screw 24 runs. A partition wall insert part 26 and a shower cover 28 are fixedly connected to the housing 14 by means of the latter.

The partition wall insert part 26 has a substantially disc-shaped lower section 30 which, as can be seen in the drawing, has a clover-leaf-like geometry in a transversal sectional view and a trough-like geometry in a radial sectional view, thus bounding a circumferential distributor chamber 32. The lower section 30 of the partition wall insert part 26 is supported on a circumferential shoulder 34 of the housing 14 and is sealed against the peripheral wall 16 of the latter by a seal 36.

The partition wall insert part furthermore has an integrally formed valve supporting block 38 which is to the right in FIG. 1 and in whose upper face there is provided a depression 40 with a rectangular cross-section. From the bottom of the latter there extends an angled feed channel 42 which opens into the peripheral surface of the partition wall insert part 26 and is aligned with a feed port 44 of the shower head 12, which port, for its part, is in communication with the hollow interior of the handle 10. A sealing ring 46, which is integrally formed with the seal 36, prevents pressurized water from flowing along the outer surface of the partition wall insert part.

In the depression 40, there sits in a form-locked manner, with the interposition of a relatively thick, elastically deformable plate seal 48, a valve seat 50 which is made of a ceramic material and whose active side, which is at the top in FIG. 1, has been polished to a high degree of evenness and a finish of good quality. Above the valve seat 50 there is provided a parallelepipedic valve slide 52 which is also made of a ceramic material and whose active surface, which is at the bottom in the drawing, has also been ground and polished to an evenness and finish of good quality. The valve slide 52 is mounted in a form-locked manner in an injection-moulded cage 54 made of plastics material of low friction and which has also a parallelepipedic shape and runs with its smooth outer surfaces with sliding play in a downwardly open guide part 56 which has also been injection-moulded of a plastics material of low friction and is fastened by means of screws 58 to the partition wall insert part 26 face that is at the top in FIG. 1. The guide part 56 is substantially rigid, and the valve slide 52 is pressed upwardly in FIG. 1 by the plate seal 48 which is subjected to elastic pre-loading in the assembled state of the shower head, so that the cage 54 is kept in abutting contact with the guide part 56. The thickness of the valve seat 50 and of the plate seal 48 has been chosen to be such that, in the assembled state of the shower head, the contact surface between the valve seat 50 and the valve slide 52 lies above the partition wall insert part 26 end face which is located at the top in FIG. 1.

Figure 2:
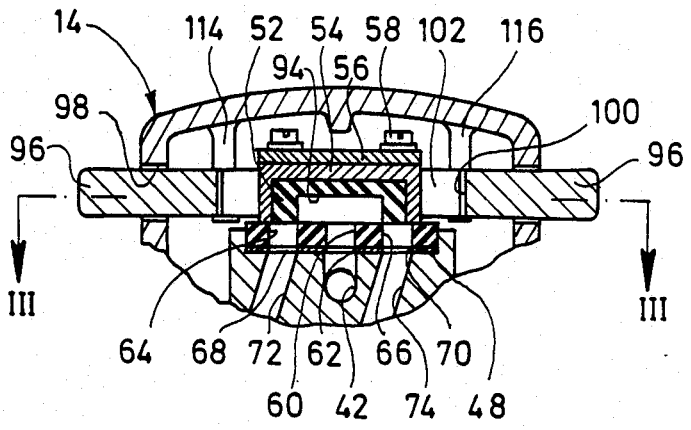
FIG. 2 shows another axially parallel section through the shower head according to FIG. 1 along the line of intersection II—II shown therein.

As can be seen particularly clearly in FIG. 2, the valve seat 50 has a central inlet control port 60 which is in communication with the angled feed channel 42 via an aligned opening 62 in the plate seal 48. Two working control ports 64, 66, which are provided on either side of the inlet control port 60, are in communication, via further openings 68, 70 in the plate seal 48, with working channels 72, 74 of the valve supporting block 38, of which one leads to the distributor chamber 32 while the other opens into the lower face of the partition wall insert part 26 radially outside the distributor chamber.

The underside of the partition wall insert part 26 has a rib 76, which follows the contour of the distributor chamber 32 and extends substantially in the peripheral direction, as well as a star-shaped central projection 78, the faces of the rib 76 and the projection 78 lying in a common plane. Onto the thus contoured underside of the partition wall insert part 26 there has been placed in a form-locked manner the shower cover 28 with a circumferential wall 79 on its top. Between the opposite faces of the partition wall insert part 26 and the shower cover 28 there has been inserted a plate seal 80 and an outer peripheral wall 81 of the shower cover 28, which wall is adapted to the housing interior, thus bounds, together with the wall 79, a shell-shaped distributor chamber 82 which is sealed against the distributor chamber 32.

The distributor chamber 82 communicates with a plurality of nozzle channels which have a narrow cross-section and through which water emerges in the form of fine hard jets when the distributor chamber 82 is acted on. By contrast, the distributor chamber 32 is in communication with four air bubblers 88, which have been inserted into the shower cover 28, via openings 86 provided in the plate seal 80. Water mixed with air is dispensed from the bubblers in the form of large soft water jets when the distributor chamber 32 is acted on with water.

As can be seen in FIG. 1, the periphery of the shower cover 28 is sealed by an O-ring 90 against the inner wall of the housing 14 and the central part located between the air bubblers 88 is provided with a depression 92, in which the head of the fastening screw 24 is received.

Figure 3:
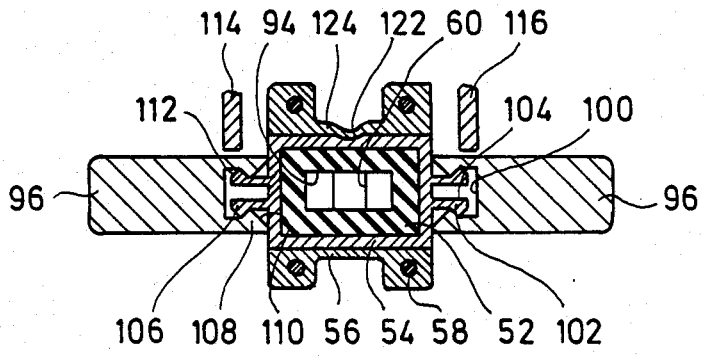
FIG. 3 shows a section through the shower head along the line III—III of FIG. 2.

The optional connection of the distributor chambers 32 and 82 to the feed channel 42 can be brought about by the adjustment of the valve slide 52. As can be seen in FIGS. 1 to 3, the valve slide 52 has a rectangular depression 94, which is open in the direction of the polished face of the slide and whose dimension, as viewed in the direction of movement, has been chosen to be exactly such that, in the central position of the valve slide 52, neither of the two working control ports 64, 66 is connected to the inlet control port 60.

When the valve slide 52 is moved to the left in FIG. 2, the working channel 72 is connected to the feed channel 42 via the depression 94; a displacement of the valve slide 52 to the right in FIG. 2 conversely leads to a connection of the working channel 74 to the feed channel 42.

For moving the valve slide 52 in these two directions, there serve two prismatic actuating members 96 which have a square cross-section and which are connected to the cage 54 via a detachable connection, which will be described in more detail hereinafter, and have been passed through guide ports 98 in the housing 14 with sliding play.

As can be seen best in FIG. 3, the actuating members 96 have at the cage end a dovetail groove 100, in which pairs of dovetail ribs 102, which are integrally formed with the cage 54, are received. The ribs are separated by a slot provided between them and are thus resilient. The width of the slot 104 is at least double the size of the outwardly projecting head section 106 of the dovetail ribs so that these, by compression, can be moved between the holding ribs 108 of the dovetail groove 100.

The holding ribs 108 have, on the outside, an oblique abutting surface 110, and the head sections 106 are provided with corresponding ramp surfaces 112. The actuating members 96 can thus be connected to the cage 54 in a manner similar to a press stud by being axially moved thereon after the partition wall insert part 26, which carries the entire valve unit, has been screwed, together with the shower cover 28, to the housing 14 in that they are passed through the guide ports 98 from the outside and pressed on the cage 54. Similarly, for dismantling the shower head 12, the actuating members 96 can be withdrawn from the cage, the support of the cage being effected by stop ribs 114, 116 which are integrally formed with the cup bottom of the housing 14 and which, in a normal operation, serve for stopping the valve slide 52 in its two working positions. Instead, one can release the connection between the actuating members 96 and the cage 54 during the dismantling of the shower head in that one simply pulls the partition wall insert part 26 from the housing 14 in the axial direction, when the dovetail ribs 102 can slide without hindrance from the dovetail grooves 100 in a direction that is perpendicular to the plane of FIG. 3.

Figure 4:
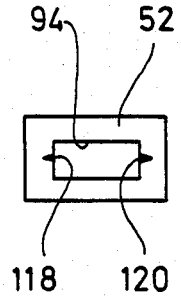
FIG. 4 shows a top view of the active surface of a control slide of the shower head.
Figure 5:
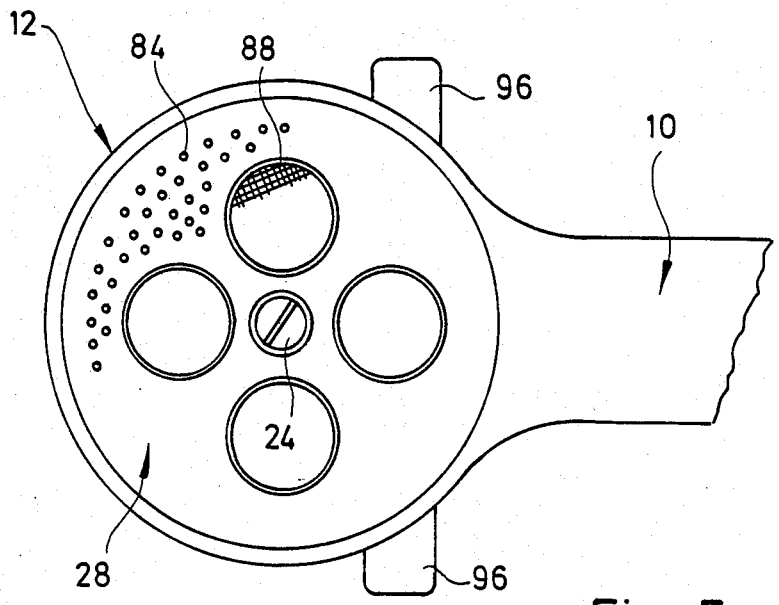
FIG. 5 shows a top view of the jet emission surface of the shower head.
Figure 6:
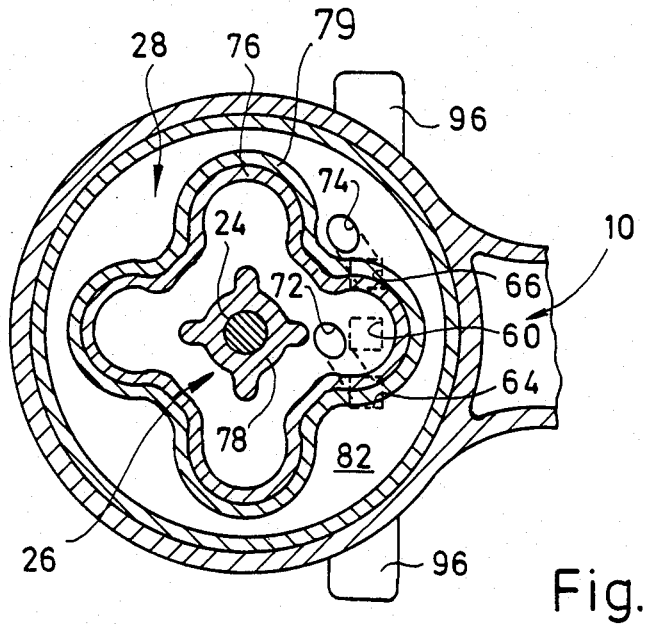
FIG. 6 shows a section, which is parallel to FIG. 5, through the shower head along the line of intersection VI—VI of FIG. 1.
Figure 7:
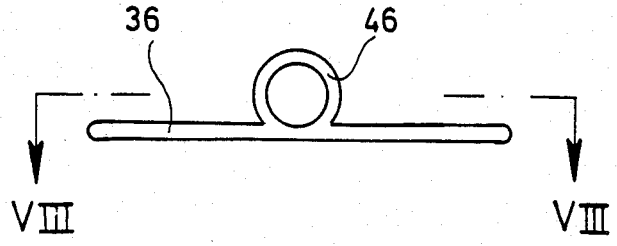
FIG. 7 shows a lateral view of a seal for sealing a partition wall insert of the shower head against the head housing.
Figure 8:
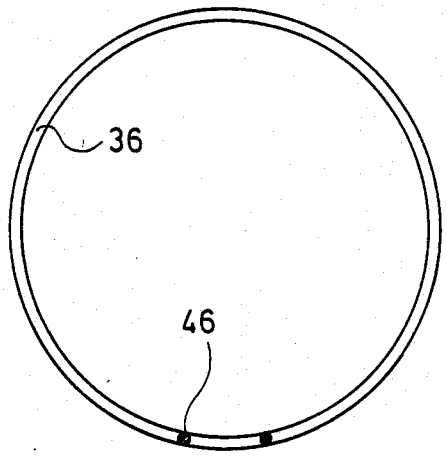
FIG. 8 shows a section through the seal shown in FIG. 7 along the line of intersection VIII—VIII therein.

The soft-jet to hard-jet change-over valve described in detail above only has the task of changing the jet but does not serve for switching the water on and off since this would mean that the flexible tube leading to the shower continues to be subjected to pressure. In order to draw the shower user's attention to the fact that the fitting serving for metering the water supply is not shut, there are provided on the depression 94 in the valve slide 52, in the end walls located in the direction of movement, leakage notches 118, 120 (see FIG. 4, in particular) so that a small quantity of water reaches the distributor chambers 32 and 82 in the central position of the valve slide 52 and the user notices from the continual dripping of the shower that the shower fitting has to be shut.

The above-described shower head can be very easily produced and fitted. The valve slide and valve seat do not come into contact with water on their outsides; one also realises that, on account of the chosen valve construction, any elaborate sealing at the points where the actuating members are passed through the housing is not necessary. Finally, the designer, too, is completely free in the choice of the shape of the shower head.

Whilst the stop ribs 114, 116 serve for specifying the two working positions of the valve slide 52, there is provided, for detenting it in its central position, in one side face of the cage 54 a depression 122 which, viewed transversely to the direction of movement, is aligned with an elastically deformable projection 124 of the guide part 56.

I claim:

1. A hand shower that includes a hollow handle defining a water feed passage and an integral cup-like housing (14) which contains (1) two distributor chambers (32, 82) that are separated flowwise by a wall (26) and one of which is in communication with at least one soft-jet port (88) and the other is in communication with hard-jet ports (84), (2) a slide change-over valve by means of which a main feed port for water (44) in the housing (14) can be connected to one or the other of the two distributor chambers (32, 82), and (3) an actuating member (96) that passes through said housing (14) characterized in that (a) said change-over valve comprising (1) a linearly guided valve slide with a facing surface (52), (2) a stationary valve seat with a facing surface (50), a portion of the facing surface on said valve slide (52) being in sliding engagement with a portion of the facing surface on said valve seat (50), a portion of said facing surface on said valve slide (52) also containing a depression (94), said facing surface of said valve seat (50) has opening out into it an inlet control port (60) connected to said main feed port (44), two working control ports (64, 66) located on the same side of said facing surface as said inlet control port and on either side of said inlet control port (60), said control ports (64, 66) being in communication through two separate passageways (72, 74) with one or the other of said two distribution chambers (32, 82), (b) said housing (14) is in the form of a unilaterally open cup and the partition wall between the two distributor chambers (32, 82) is formed by a partition wall insert (26) which is positioned within the housing (14) and which carries said valve seat (50) and contains a feed channel (42), which leads from the inlet control port (60) in the valve seat (50), as well as said two separate passageways (72, 74) which lead to one or the other of the distributor chambers (32, 82).

2. A hand shower as set forth in claim 1 wherein on an outer surface of the partition wall insert part (26) there is provided a ring seal (46) which surrounds the point at which the feed channel (42) opens out.

3. A hand shower as set forth in claim 1 wherein the partition wall insert part (26) is sealed against a peripheral wall (16) of the housing (14) by a ring seal (36).

4. A hand shower as set forth in claim 1 wherein the valve slide (52) sits in a form-locked manner in a cage (54) which is open towards the facing surface of the valve seat (50) and which, for its part, has a prismatic outer surface and runs in a complementary guide part (56), which is fastened on the partition wall insert part (26) face pointing towards the cup bottom.

5. A hand shower as set forth in claim 4 wherein the cage (54) has end faces and at least one of the end faces of the cage (54) lying in the direction of movement is provided with interlocking means (102) which cooperate with complementary interlocking means (100) of the actuating member (96).

6. A hand shower as set forth in claim 5 wherein the complementary interlocking means (100, 102) on the cage (54) and the actuating member (96) respectively form a dovetail joint, whose direction of insertion extends parallel to the direction of installation of the partition wall insert part (26) into the housing (14).

7. A hand shower as set forth in claim 5 wherein the complementary interlocking means (100, 102) on the cage (54) and the actuating member (96) are formed by detent means.

8. A hand shower as set forth in claim 7 wherein the positive dovetail guide means (102) are slotted (104) so that they simultaneously form a plug which can be resiliently introduced into the negative dovetail guide means (100).

9. A hand shower as set forth in claim 4 wherein the guide part (56) comprises a detent section (124) which projects elastically from the guide surface and which, in the central position of the valve slide (52) engages elastically in an aligned depression (122) in the cage (54).

10. A hand shower as set forth in claim 4 wherein the housing (14) is provided with stop ribs (114, 116) which define the working positions of the valve slide (52).

11. A hand shower as set forth in claim 1 wherein the valve slide (52) has end walls which are to the front and rear as viewed in the direction of movement and are provided with leakage notches (118, 120).

12. A hand shower as set forth in claim 1 wherein a shower cover (28) which comprises the hard-jet ports (84) and the soft-jet ports (88), has an outer peripheral wall (81) which is insertable into the housing (14), and an inner peripheral wall (79), which is radially inwardly offset thereto and is sealed (80) against the partition wall insert part (26), which walls together specify a shell-shaped hard-jet distributor chamber (82) which closely surrounds the soft-jet ports (88).

13. A hand shower as set forth in claim 12 wherein the inner peripheral wall (79) of the shower cover (28) engages positively over a projection (76, 80) of the partition wall insert part (26), and in that the opposite end faces of the partition wall insert part (26) and of the shower cover (28) are sealed flatly against one another by a plate seal (80).

14. A hand shower as set forth in claim 12 wherein the partition wall insert part (26) and the shower cover (28) are fastened to the housing (14) by a single central fastening means (24).

15. A hand shower as set forth in claim 1 wherein the valve seat (50) sits positively in a depression (40) in the partition wall insert part (26) with the interposition of a bottom seal (48), and in that the thickness of the bottom seal has been chosen, taking into consideration the thickness of the valve seat (50), to be such that the contact surface between the valve seal (50) and the valve slide (52), in the assembled state of the shower head, is seated in the partition wall insert part (26) and the valve seat (50) is thus held on the valve slide (52) in elastic sliding contact.

* * * * *